US006892404B2

(12) United States Patent
Harbin et al.

(10) Patent No.: US 6,892,404 B2
(45) Date of Patent: May 17, 2005

(54) TOP BED SHEET WITH FITTED FOOT END

(76) Inventors: Keith E. Harbin, 8107 Sorrento, Detroit, MI (US) 48228; Deborah A. Harbin, 8107 Sorrento, Detroit, MI (US) 48228

( * ) Notice: Subject to any disclaimer, the term of this patent is extended or adjusted under 35 U.S.C. 154(b) by 0 days.

(21) Appl. No.: 10/819,396

(22) Filed: Apr. 7, 2004

(65) Prior Publication Data

US 2004/0200000 A1 Oct. 14, 2004

Related U.S. Application Data

(60) Provisional application No. 60/461,568, filed on Apr. 9, 2003.

(51) Int. Cl.[7] ..... A47G 9/02
(52) U.S. Cl. ..... 5/497; 5/485; 5/499
(58) Field of Search ..... 5/482, 485, 497–500, 5/502, 737, 738

(56) References Cited

U.S. PATENT DOCUMENTS

| | | | | | |
|---|---|---|---|---|---|
| 1,267,593 | A | | 5/1918 | Roever | |
| 1,726,224 | A | | 8/1929 | Handl | |
| 1,865,329 | A | * | 6/1932 | McHorter | 5/497 |
| 2,151,375 | A | * | 3/1939 | De Voe | 5/497 |
| 2,440,891 | A | * | 5/1948 | Bockhold | 5/496 |
| 2,454,463 | A | * | 11/1948 | Kromer et al. | 5/497 |
| 2,499,698 | A | * | 3/1950 | Thomas | 5/499 |
| 2,641,001 | A | | 6/1953 | Krasnov | |
| 2,679,056 | A | * | 5/1954 | Simpson | 5/485 |
| 2,757,389 | A | * | 8/1956 | King | 5/496 |
| 2,789,292 | A | | 4/1957 | Budinquest | |
| 3,654,646 | A | * | 4/1972 | McMahon, Jr. | 5/497 |
| 3,824,640 | A | * | 7/1974 | Golden | 5/485 |
| 4,245,365 | A | * | 1/1981 | Large | 5/496 |
| 4,344,196 | A | * | 8/1982 | Large | 5/496 |
| 4,386,439 | A | | 6/1983 | Roccograndi | |
| 4,402,098 | A | | 9/1983 | McClam | |
| 4,546,508 | A | | 10/1985 | Ison | |
| 4,841,588 | A | | 6/1989 | Harbin et al. | |
| 5,027,460 | A | * | 7/1991 | Honig | 5/497 |
| D324,971 | S | * | 3/1992 | Blocker | D6/602 |
| 5,165,128 | A | * | 11/1992 | Honig | 5/497 |
| 5,442,822 | A | * | 8/1995 | Diaz | 5/497 |
| 6,134,730 | A | | 10/2000 | Evanson | |
| 6,353,947 | B1 | | 3/2002 | McCain et al. | |
| 6,499,157 | B1 | | 12/2002 | McCain et al. | |
| 6,502,258 | B1 | * | 1/2003 | Mitchell | 5/497 |
| 2004/0200000 | A1 | * | 10/2004 | Harbin et al. | 5/497 |

* cited by examiner

*Primary Examiner*—Robert G. Santos
(74) *Attorney, Agent, or Firm*—Brooks Kushman P.C.

(57) ABSTRACT

A top sheet having a fitted foot end and method of assembling a fitted sheet to a mattress are disclosed. The foot pocket has a foot end face panel that extends over a foot end of the mattress and a foot tuck panel that is tucked beneath the bottom surface of the mattress. The foot pocket further comprises right and left side corner panels that adjoin to both the foot end face panel and a top portion of the sheet to define a three sided corner that locates the sheet on the foot end of the mattress. According to the method the top sheet is spread over the mattress with the right and left side corners located on the right and left top corners of the foot end of the mattress and a foot tuck panel is tucked under the mattress to secure the sheet to the mattress.

7 Claims, 2 Drawing Sheets

TOP BED SHEET WITH FITTED FOOT END

CROSS-REFERENCE TO RELATED APPLICATION

This application claims the benefit of U.S. Provisional Application Ser. No. 60/461,568 filed Apr. 9, 2003.

BACKGROUND OF THE INVENTION

1. Field of the Invention

The present invention relates to bed linens, and in particular to a top sheet for a bed.

2. Background Art

Children and adults alike have long struggled with the daily chore of making their beds. Generally a set of bed sheets includes a fitted bottom sheet and a flat top sheet that are provided under a decorative and insulative blanket. Conventional top sheets are generally folded into a hospital corner or may be simply tucked in around the base of the bed. A hospital corner is formed by initially folding the bottom portion of the blanket under the mattress and lifting the side portions vertically upwardly while tucking the portion of the sheet that extends below the mattress under the mattress preferably forming a diagonal fold extending from the top corner of the foot end of the bed downwardly toward the head of the bed as the side portion of the sheet hangs downwardly from the side edge of the mattress. Depending upon the skill of the bed maker, the top sheet may have an untidy appearance. With training and practice a bed may be made with good results, however, if the top sheet is not correctly folded the top sheet may be pulled from beneath the mattress or may be too tight. If the top sheet becomes loose it may result in cold feet but if it is too tight it may restrict foot movement in an unacceptable manner.

A top sheet may also be secured to the bed in the wrong position. If too much of the top sheet is folded underneath the mattress the portion of the top sheet on top of the mattress may be insufficient to cover a person's shoulders when lying in the bed. If an insufficient amount of the sheet is folded under the mattress the top sheet becomes too long and is more likely to work loose and not be retained by the weight of the mattress. The person making the bed may have to repeat the process, wasting time and effort if the top sheet is not correctly positioned.

U.S. Pat. No. 4,841,588 was issued to the applicants and provides a solution in the form of a specialized "bed maker's blanket" that improves the bed making process. However, the blanket disclosed proposes a top sheet that is sewn on its lower end to a fitted sheet and is buttoned to the lower surface of the bed makers blanket. It has been found that providing a combined top/bottom sheet that may be buttoned to the blanket is not the best solution because of the added expense of a combined top and bottom sheet. Also, additional time is necessary to install the combined top/bottom sheet and button it to the blanket.

Another proposed solution to the problem of providing an improved bed linen product is proposed in U.S. Pat. No. 6,134,730. In the '730 patent, the solution proposed is to provide a blanket and top and bottom sheet that are buttoned together in a three layer construction. The three layers are then secured to a separate pocket and a pocket support panel. This proposed solution would be expensive to manufacture and is not useable with conventional blankets or conventional fitted bottom sheets.

There is a need for a fast and easy way to make a bed that results in a bed being perfectly made every time and that stays in place while providing minimum restrictiveness to normal movement of a person lying in the bed. In particular, there is a need for a top sheet that facilitates bed making by a child or an adult that may be accomplished easily without training or extensive practice.

SUMMARY OF INVENTION

According to one aspect of the invention a partially fitted top sheet having a fitted foot pocket with the remainder of the sheet being a flat sheet is provided. The fitted foot pocket stabilizes the sheet and provides a sheet that is installed in the optimum position every time. The partially fitted top sheet eliminates the need to repeat the bed making process that occurs with conventional top sheets when they are not placed on the bed in the proper position.

According to another aspect of the present invention a partially fitted top sheet is provided that may be used with traditional bedding products such as fitted bottom sheets and conventional blankets that are widely available.

According to yet another aspect of the invention, a partially fitted top sheet is provided that greatly improves the process of initially attaching the top sheet to a bed and also facilitates maintaining the bed in its made up condition.

A partially fitted top sheet as disclosed can be made to fit any bed or mattress size such as a twin, full, queen or king size mattress and may be used with a mattress and box spring set or platform bed.

This unique design for a top sheet may be strategically cut from flat material and simply sewn. The unique design can be manufactured from the same size fabric blank as a conventional flat top sheet and, in fact, can be manufactured from a commercially available standard flat top sheet. Only a minimum additional amount of labor is required to manufacture the unique partially fitted top sheet of the present invention when compared to the labor required to manufacture a conventional flat top sheet.

According to one aspect of the present invention, a top sheet for a mattress is provided. The mattress has a top surface, a bottom surface, a head end, a right side and a left side. The sheet comprises a top portion that extends over the top surface of the mattress. The sheet also has right and left side flaps that extend from the top surface of the mattress downwardly over the right and left sides of the mattress, respectively. The sheet additionally has a flip pocket that further comprises a foot end face panel extending downwardly from the top surface of the mattress over the foot end of the mattress, a foot tuck panel that is tucked beneath the bottom surface of the mattress, and right and left side corner panels. The right and left side corner panels are joined to the foot end face panel at a vertical edge and are joined to the top portion at a horizontal edge to define a three sided corner covering portions of the top surface of the mattress, the right side of the mattress and the foot end of the mattress. A left side corner panel is joined to the foot end face panel at a vertical edge and the top portion at a horizontal edge. The left side corner panel covers portions of the top surface of the mattress, the left side of the mattress and the foot end of the mattress. The right and left side corner panels locate the sheet on the foot end of the mattress. According to other aspects of the invention, the right and left side corner panels of the top sheet are spaced from the right and left side flap, respectively. A right edge reinforcement and a left edge reinforcement comprising L-shaped members are attached to the top portion of the sheet near the foot end of the mattress and a foot end edge of the right and left side flaps, respectively. The right and left edge reinforcers are pieces of fabric having a first portion disposed in a horizontal plane corresponding to the top surface of the mattress and a second portion disposed in a vertical plane corresponding to the right and left sides of the mattress, respectively. Right and left lower side corner panel reinforcements may be provided that comprise L-shaped members that have a first leg secured to the foot tuck panel and a second leg secured to a lower edge of the right and left side corner panels, respectively.

According to another aspect of the present invention, a sheet for bedding including a mattress having a top surface, bottom surface, a head end, a foot end, a right side, and a left side is provided. The top surface and right side form a right edge of the mattress while the top surface and left side form a left edge of the mattress. The foot end and bottom surface form a bottom foot edge of the mattress. The sheet comprises the main portion that lies at the top surface of the bed. A right side flap extends from the right side main portion over the right edge of the bed. A left side flap extends from the left side main portion over the left edge of the bed. A foot pocket having a foot end face panel, a right side corner and a left side corner is also provided. The foot end face panel extends between the right side corner and the left side corner. The foot end face panel has a top portion, a right portion, a lower portion, and a left portion. The foot end face panel covers the foot end of the mattress. A foot tuck panel extends from the lower portion of the foot end face panel and is tucked under the bottom surface of the mattress. A right foot end side panel extends from the foot end face panel toward the right side flap. A left foot end side panel extends from the foot end face panel toward the left side flap. The right side corner is formed by a portion of the right side of the main portion, a portion of the foot end face panel, and the right foot end side panel. Similarly, the left side corner is formed by a portion of the left side of the main portion, a portion of the foot end face panel and the left foot end side panel. The right and left side corners locate the sheet on the foot end of the mattress.

According to another aspect of the invention as it relates to the method of fitting a sheet to a mattress, a mattress and sheet as described above are assembled by a method comprising spreading the sheet over the mattress so that the right and left side flaps at least partially cover the right and left sides of the mattress. The right and left side corners of the sheet are located on right and left top foot corners of the mattress. The foot tuck panel is then tucked under the mattress to secure the sheet to the mattress.

Finally, the present invention provides a cost effective solution that may be easily manufactured and readily implemented by bed makers everywhere without training or extensive practice.

The above problems associated with prior art bed linen and previously proposed solutions are addressed by Applicant's invention as shown in the attached drawings and described in the following detailed description of the invention. The above noted aspects of the invention are not exclusive of other aspects as will be understood by one of ordinary skill in the art in view of the attached drawings and following description.

DETAILED DESCRIPTION OF THE PREFERRED EMBODIMENTS

Figure 1:
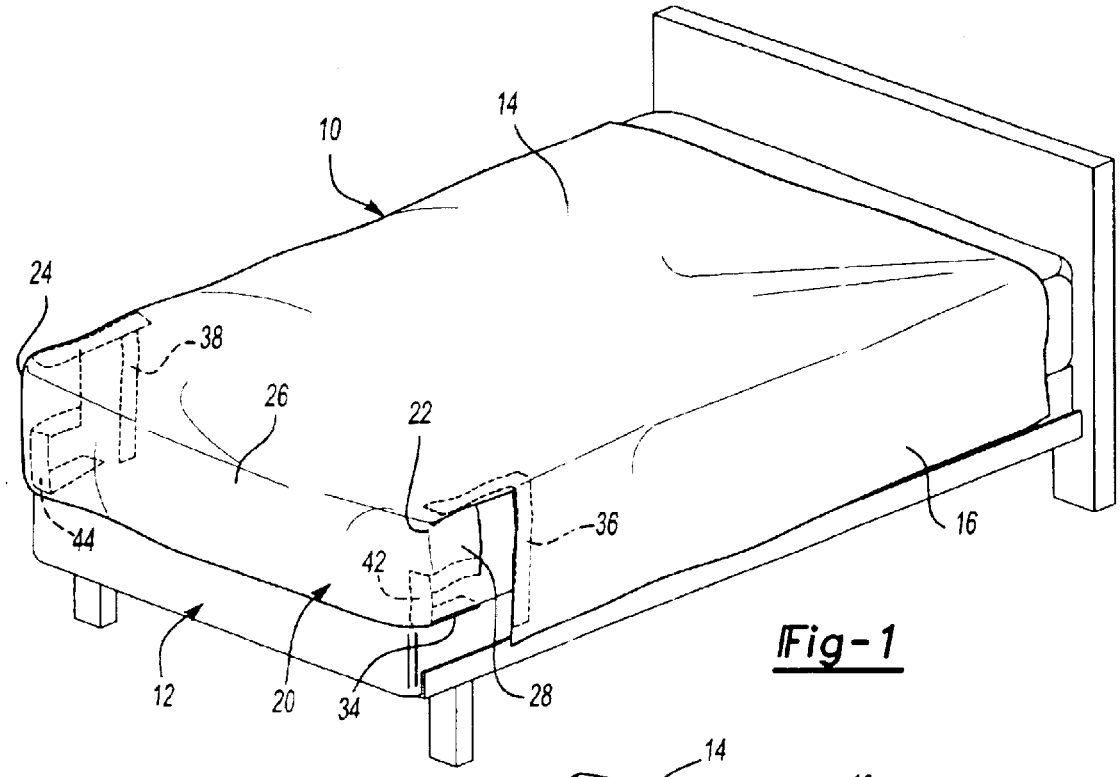
FIG. 1 is a perspective view of a partially fitted top sheet made in accordance with the present invention attached to a bed.

Referring to FIG. 1, a partially fitted top sheet generally referred to by reference numeral 10 is shown attached to a bed generally indicated by reference numeral 12. The top sheet 10 includes a main, or top, portion 14 that lies on the top surface of the bed 12. A right side flap 16 extends over the right edge of the bed 12. As used herein, the terms right and left refer to the sides of the bed when viewed from the foot of the bed. Referring now to FIG. 1, a left side flap 18 is provided on the opposite side of the main portion 14 from the right side flap 16.

Figure 2:
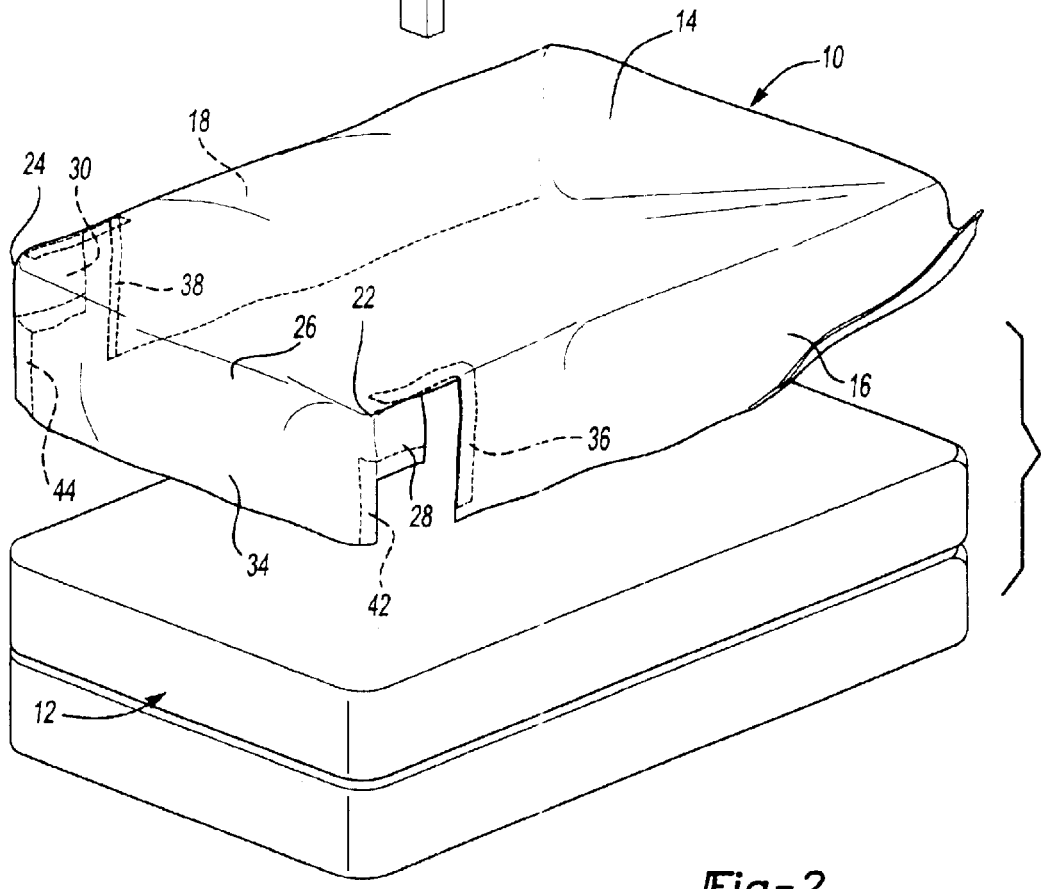
FIG. 2 is an exploded perspective view showing the partially fitted top sheet suspended above a mattress.
Figure 3:
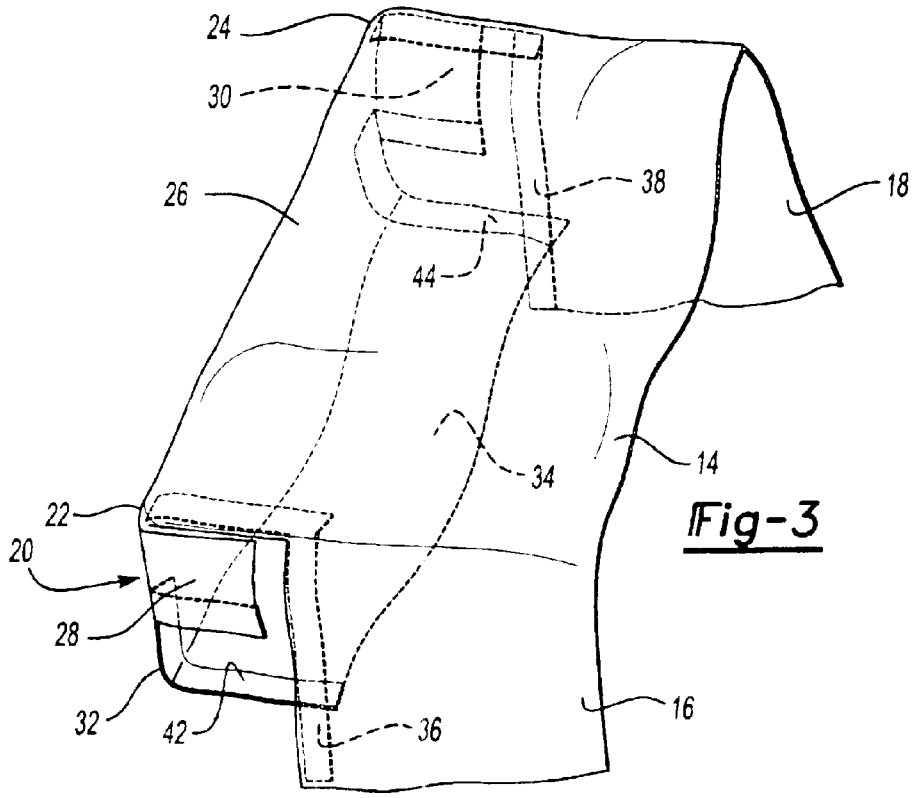
FIG. 3 is a fragmentary perspective view of the foot end of the partially fitted top sheet.

Referring to FIGS. 1, 2 and 3, a foot end pocket 20 encompasses the foot end of the bed 12. The foot end pocket 20 has a right side corner 22 and a left side corner 24 on the right and left sides of the bed 12, respectively. A foot end face panel 26 extends between the right side corner 22 and left side corner 24 and downwardly over the foot end of the bed 12. The right side corner is formed in part by a right foot end side panel 28. The left side corner 24 is partially formed by the left foot end side panel 30.

A foot tuck panel 34 extending from the lower portion of the foot end face panel 26 is provided and is normally tucked under the mattress of the bed 12 to secure the foot end pocket 20 to the bed 12. A right edge reinforcement 36 and left edge reinforcement 38 are provided to reinforce the side flap 16 and 18 to prevent tearing of the top sheet 10. The edge reinforcements 36 and 38 may be L-shaped fabric pieces that are sewn to the side flaps 16 and 18 and also to the main portion 14 of the sheet 10. The edge reinforcements may also be of different shapes, for example, in the shape of a square with its corner missing. The edge reinforcements may also be attached by methods other than sewing including riveting or adhering. The edge reinforcements may be cut from the gap between the rights and left foot end side panels 28, 30 and the side flaps 16 and 18 and then attached to the top sheet 10 as illustrated. The right and left edge reinforcements 36 and 38 are shown secured to the side flaps 16, 18 and main portion 14 of the sheet 10.

Figure 4:
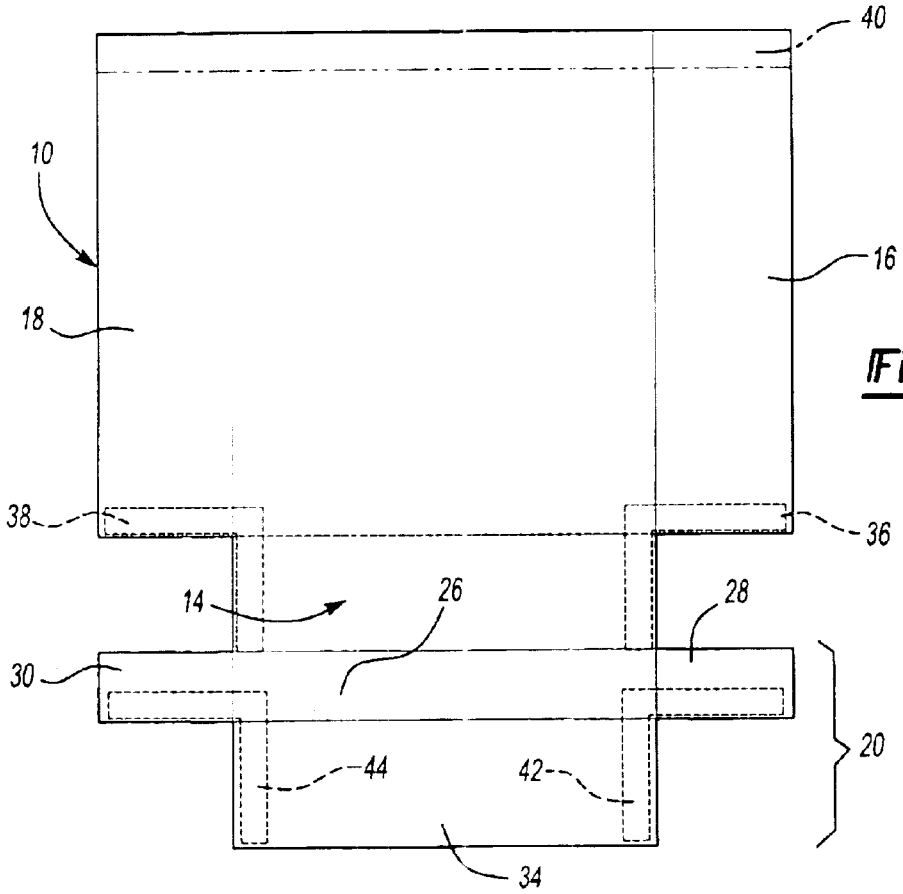
FIG. 4 is a plan view of the partially fitted top sheet unfolded and unattached to a bed.

Referring now to FIG. 4, a trim facing 40 is shown at the head end of the sheet 10. The trim facing 40 may be provided for decorative purposes. The top sheet 10, as shown in FIG. 4, is separate from a bed in an unfolded condition. The right and left side flaps 16 and 18 are shown in the same plane as the main portion 14. The foot end pocket 20 is shown without folds wherein the foot end tuck flap 34 and foot end face panel 26 are also in the same plane as the main portion 14. The right and left foot end side panels 28, 30 are shown extending in the same plane as the other portions of the top sheet 10.

Referring to FIGS. 1–4, a right lower side corner reinforcement 42 and a left lower side reinforcement 44 may be provided to reinforce the side corner panels 28 and 30 and foot tuck panel 34. The reinforcements 42 and 44 also function to hold the panels 28, 30 and 34 which improves the appearance of the foot pocket.

The partially fitted top sheet 10 is secured to a bed 12 after the fitted bottom sheet is placed on the mattress. The top sheet 10 is initially spread over the fitted bottom sheet and across the surface of the bed allowing the side flaps 16 and 18 to fall over the edges of the mattress. The side corners 22 and 24 provide a reference location so that the side flaps are evenly deployed on opposite sides of the bed 12. The foot end face panel 26 and foot tuck flap 34 initially extend downwardly from the foot end of the bed 12. The foot tuck flap 34 is then tucked beneath the mattress of the bed with the length of the sheet 10 being controlled by the location of the side corners 22 and 24.

As will be readily appreciated, the top sheet is stabilized by virtue of the foot end pocket 20 being secured to the foot end of the bed 12. Since the foot end of the top sheet 10 is securely attached to the bed 12, making the bed is simplified because the top portion 14 is automatically positioned perfectly on the bed 12.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A top sheet for a mattress having a top surface, a bottom surface, a head end, a foot end, a right side and a left side, the sheet comprising:

a top portion that extends over the top surface of the mattress;

a right side flap extending from the top surface of the mattress downwardly over the right side of the mattress;

a left side flap extending from the top surface of the mattress downwardly over the left side of the mattress;

a foot pocket further comprising a foot end face panel extending downwardly from the top surface of the mattress over the foot end of the mattress, a foot tuck panel that is tucked beneath the bottom surface of the mattress, a right side corner panel being joined to the foot end face panel at a vertical edge and the top portion at a horizontal edge to thereby define a three sided corner covering portions of the top surface of the mattress, the right side of the mattress and the foot end of the mattress, and a left side corner panel being joined to the foot end face panel at a vertical edge and the top portion at a horizontal edge to thereby define a three sided corner covering portions of the top surface of the mattress, the left side of the mattress, and the foot end of the mattress, wherein the right and left side corner panels locate the sheet on the foot end of the mattress; and a right edge reinforcement and a left edge reinforcement, wherein the right edge reinforcement is an L-shaped member that is attached to the top portion of the sheet near the foot end of the mattress and is also attached to a foot end edge of the right side flap, and the left edge reinforcement is an L-shaped member that is attached to the top portion of the sheet near the foot end of the mattress and is also attached to a foot end edge of the left side flap.

2. The top sheet of claim 1 wherein the right and left side corner panels are spaced from the right and left side flaps, respectively.

3. The top sheet of claim 1 wherein the right and left edge reinforcements are pieces of fabric that have a first portion disposed in a horizontal plane corresponding to the top surface of the mattress, and a second portion disposed in a vertical plane corresponding to the right and left sides of the mattress, respectively.

4. A top sheet for a mattress having a top surface, a bottom surface, a head end, a foot end, a right side and a left side, the sheet comprising:

a top portion that extends over the top surface of the mattress;

a right side flap extending from the top surface of the mattress downwardly over the right side of the mattress;

a left side flap extending from the top surface of the mattress downwardly over the left side of the mattress;

a foot pocket further comprising a foot end face panel extending downwardly from the top surface of the mattress over the foot end of the mattress, a foot tuck panel that is tucked beneath the bottom surface of the mattress, a right side corner panel being joined to the foot end face panel at a vertical edge and the top portion at a horizontal edge to thereby define a three sided corner covering portions of the top surface of the mattress, the right side of the mattress and the foot end of the mattress, and a left side corner panel being joined to the foot end face panel at a vertical edge and the top portion at a horizontal edge to thereby define a three sided corner covering portions of the top surface of the mattress, the left side of the mattress, and the foot end of the mattress, wherein the right and left side corner panels locate the sheet on the foot end of the mattress; and a right lower side corner panel reinforcement and a left lower side corner panel reinforcement, wherein the lower side corner panel reinforcements are L-shaped members that have a first leg secured to the foot tuck panel and a second leg secured to a lower edge of the right and left side corner panels, respectively.

5. A sheet for a bed including a mattress having a top surface, a bottom surface, a head end, a foot end, a right side, and a left side, the top surface and right side forming a right edge, the top surface and left side forming a left edge, the foot end and bottom surface forming a bottom foot edge, the sheet comprising:

a main portion that lies on the top surface of the bed, the main portion having a head end, a right side, a foot end, and a left side;

a right side flap extending from the right side main portion over the right edge of the bed;

a left side flap extending from the left side main portion over the left edge of the bed;

a foot pocket having a foot end face panel, a right side corner, and a left side corner, the foot end face panel extending between the right side corner and the left side corner, the foot end face panel having a top portion, a right portion, a lower portion, and a left portion, the foot end face panel covering the foot end of the mattress, a foot tuck panel extending from the lower portion of the foot end face panel and is tucked under the bottom surface of the mattress, a right foot end side panel extending from the foot end face panel toward the right side flap and a left foot end side panel extending from the foot end face panel toward the left side flap, the right side corner being formed by a portion of the right side of the main portion, a portion of the foot end face panel, and the right foot end side panel, the left side corner being formed by a portion of the left side of the main portion, a portion of the foot end face panel, and the left foot end side panel, wherein the right side corner and left side corner locate the sheet on the foot end of the mattress; and a right edge reinforcement attached to the right side flap and the main portion, and a left edge reinforcement attached to the left side flay and the main portion, wherein the right and left edge reinforcements are L-shaped fabric pieces.

6. The sheet of claim 5 wherein the main portion includes a trim facing attached to the head end of the sheet.

7. A method for fitting a sheet to a mattress, the mattress having a top surface, a bottom surface, a head end, a foot end, a right side, and a left side, the top surface and right side forming a right edge, the top surface and left side forming a left edge, the foot end and bottom surface forming a bottom foot edge, the top surface, right side, and foot end forming a top right foot corner, the top surface, left side, and foot end forming a top left foot corner, the sheet having a main portion that lies on the top surface of the bed, a right side flap extending from the main portion over the right side of the bed and a left side flap extending from the main portion over the left side of the bed, a foot pocket having a foot end face panel covering the foot end of the mattress, a foot tuck panel extending from a lower portion of the foot end face panel, the foot tuck panel covering the bottom foot edge of the mattress and being tucked under the mattress, a right foot end side panel extending from the foot end face panel in the same plane as the right side flap and a left foot end side panel extending from the foot end face panel in the same plane as the left side flap, the right side corner being formed by a portion of the right side main portion, a portion of the foot end face panel and a portion of the right foot end side panel, the left side corner being formed by a portion of the left side main portion, a portion of the foot end face panel and a portion of the left foot end side panel, a right edge reinforcement and a left edge reinforcement, wherein the right edge reinforcement is an L-shaped member that is attached to the main portion of the sheet near the foot end of the mattress and is also attached to a foot end edge of the right side flap, and the left edge reinforcement is an L-shaped member that is attached to the main portion of the sheet near the foot end of the mattress and is also attached to a foot end edge of the left side flap wherein the right side corner and left side corner locate the sheet on the mattress, the method comprising:

spreading the sheet over the mattress such that the right and left side flaps at least partially cover the right and left sides of the mattress;

locating the right side and left side corners of the sheet on the right and left top foot corners of the mattress with the right and left edge reinforcements functioning to reinforce the main portion of the sheet and the right and left side flaps, respectively; and tucking the foot tuck panel under the mattress to secure the sheet to the mattress.

* * * * *